US011488565B1

(12) United States Patent
Miller

(10) Patent No.: US 11,488,565 B1
(45) Date of Patent: Nov. 1, 2022

(54) INTERCHANGEABLE TRIANGLE BEATER

(71) Applicant: Willard A Miller, Seattle, WA (US)

(72) Inventor: Willard A Miller, Seattle, WA (US)

( * ) Notice: Subject to any disclaimer, the term of this patent is extended or adjusted under 35 U.S.C. 154(b) by 0 days.

(21) Appl. No.: 17/391,360

(22) Filed: Aug. 2, 2021

(51) Int. Cl.
*G10D 13/12* (2020.01)
*G10D 13/06* (2020.01)

(52) U.S. Cl.
CPC ..... *G10D 13/12* (2020.02); *G10D 13/06* (2013.01)

(58) Field of Classification Search
CPC ..... G10G 7/00; G10D 13/00; G10D 13/06; G10D 3/12
See application file for complete search history.

(56) References Cited

U.S. PATENT DOCUMENTS 2,108,693 A 2/1938 Sewell

FOREIGN PATENT DOCUMENTS

| | | | | |
|---|---|---|---|---|
| CN | 210575064 | U | 5/2020 | |
| EP | 2107552 | A1 * | 10/2009 | ..... G10D 13/003 |
| GB | 28766 | | 12/1905 | |
| JP | 7-3636 | | 1/1995 | |
| JP | 6221099 | B2 | 10/2017 | |
| KR | 10-1228619 | | 1/2013 | |
| TW | I544949 | B | 8/2016 | |

OTHER PUBLICATIONS 6-in-1 Interchangeable Screwdriver—6 Types of Head Tips, Flat and Phillips, (Pack of 2). https://www.amazon.com/Interchangeable-Screwdriver-6-Types-Head-Phillips/dp/B00VLIJNFI (1pg) At least as early as May 28, 2021.

Amartisan Magnetic Rachet Screwdriver Set—34-Piece Multi-bit Ratchet Screw Drivers, Slotted/Philips/Pozi/Torx/Hex. https://www.amazon.com/Amartisan-Magnetic-Screwdriver-34-Piece-Multi-bit/dp/B0881XQTQD/ref=sr_1_7?dchild=1&keywords=Magnetic+Head+Screwdriver+Sets&qid=1622234839&sr=8-7 (2 pgs) At least as early as May 28, 2021.

SPEED KICK™ Two-Way Beater Starter System. http://www.aheaddrumsticks.com/beaters-ahsk.html#.YG3Thi2cZMB (3 pgs), At least as early as Apr. 7, 2021.

* cited by examiner

*Primary Examiner* — Kimberly R Lockett
(74) *Attorney, Agent, or Firm* — R. Reams Goodloe, Jr.

(57) ABSTRACT

A triangle beater having interchangeable and detachable heads. A triangle beater for striking a percussion instrument is described. The triangle beater has a shaft with a grip end having a grip thereon, and a working end. The working end includes a connector assembly. A detachable beater head is provided. The beater head extends along a longitudinal axis from a proximal end to a distal end. The beater head further includes a connector assembly receiver. The connector assembly receiver and the connector assembly are configured with at least some components use ferromagnetic material, so that when they are juxtaposed by bringing the connector assembly and the connector assembly receiver together into a working position, the connector assembly receiver and the connector assembly are magnetically secured together for striking a percussion instrument such as a triangle. The connector assembly and connector assembly receiver are separable by manually urging them apart and overcoming magnetically attractive force therebetween.

20 Claims, 5 Drawing Sheets

INTERCHANGEABLE TRIANGLE BEATER

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever

RELATED PATENT APPLICATIONS

NONE

TECHNICAL FIELD

This disclosure is directed to musical instruments, namely triangle beaters, and more particularly, to beater heads for triangle beaters, and to apparatus and methods for connecting a beater head with a shaft of a triangle beater.

BACKGROUND

Triangles are well known and widely used by musicians, and thus, a wide variety of triangle beaters are also well known and widely used for striking triangles. Different types of beater heads may be selected in order to achieve a desired sound when using a specific triangle. Further, although triangle beaters are most commonly used in a hand held manner, one product which has gained increasing acceptance among musicians, and illustrated in FIG. 1, is a device 10 known as The Miller Machine™, The device 10 is used to secure a prior art triangle beater 12 in a working position below a triangle 14. When using device 10 with a prior art triangle beater 12, if a different sound is desired, the triangle beater 12 must be removed mechanically from the device 10. In an embodiment, the triangle beater 12 has a shaft 16 has a handle end 18 on which an actuator sleeve (or grip) 20, usually manufactured of a selected rubber material, is affixed. At the other end, a beater head 21 is provided. The actuator sleeve 20 is used for manipulating the triangle beater 12, either by hand or with a striker such as a drumstick (not shown). Removal of the triangle beater 12 from device 10 is achieved by removing the actuator sleeve 20 and then sliding the shaft 16 of the triangle beater 12 axially out through the rubber grommets 22 and 24 that hold the triangle beater 12 in place on device 10. Then, a new beater head (not shown, similar to beater head 21) and shaft (not shown but similar to or identical to shaft 16) with a beater head of different size and/or material of construction may be installed, by inserting a shaft (not shown but functionally the same as shaft 16, through the rubber grommets 22 and 24. Then, the grip 20 is installed on the new shaft, and a different triangle beater is ready for use.

Alternately as indicated in FIG. 2, instead of using The Miller Machine™ device 10, a musician may carry a plurality of triangle beaters, and simply select a desired triangle beater 30 from his personal collection of triangle beaters, and thus use a prior art triangle beater 12 to play by hand, and thus achieve his desired musical result.

However, since it is not easy to quickly change triangle beater heads when using The Miller Machine™ device 10, there remains a need for an improved design for a triangle beater, and for an improved method for installation of a triangle beater head when the triangle beater is installed on The Miller Machine™ device 10. More generally, it would be advantageous if an improved triangle beater design were available that enabled the use of a kit containing, in compact fashion, a plurality of triangle beater heads, any one of which might be easily selected in installed to achieve a desired musical sound.

Some Objects, Advantages, and Novel Features

An object of the invention(s) disclosed herein is to solve the above-described problems, by providing a new triangle beater design that provides for easily assembled interchangeable beater heads.

An object of the invention(s) disclosed herein is to solve the above-described problem of difficulty of changing triangle beater heads, by providing a new triangle beater design that dramatically reduces time required for change of the beater head of a triangle, thus making it easier to change beater heads during a musical performance.

It is an advantage of the invention(s) disclosed herein that the time required for changing a triangle beater head, especially when installed on The Miller Machine™ is significantly reduced, as compared to prior art designs.

It is an advantage of the invention(s) disclosed herein that the reliability of the triangle beater designs is maintained or improved, due to use of high strength components as necessary for reliable for operation.

The above objects and various advantages of the invention(s) as disclosed herein will become more apparent from the description provided and details of various embodiments, as will be understood by those skilled in the art.

SUMMARY

An improved triangle beater design has been developed and is described herein. The triangle beater comprises a shaft, a grip, and a beater head. The beater head is interchangeable, and detachable from the shaft. In an embodiment, the shaft has a grip end and a working end. The grip is attached to the grip end. The working end of the shaft further may further include a connector assembly. The beater head extends along a longitudinal axis from a proximal end to a distal end. In an embodiment, the beater head may be cylindrical in shape. In an embodiment, the beater head may be shaped with multiple cylindrical components of different diameter along the longitudinal axis. In an embodiment, the beater head may further include a selected shaped head end, and in a selected embodiment the shaped head end may be substantially spherical in shape.

In an embodiment, the beater head may further include a connector assembly receiver. In various embodiments, the connector assembly receiver and the connector assembly are configured with at least some components comprised of ferromagnetic materials that, when juxtaposed by bringing the connector assembly and the connector assembly receiver together into a working position, magnetically join the shaft and the beater head together into a secure working position for working together to strike a triangle. In an embodiment, a steel cap is provided on the shaft, and a tubular cylindrical steel sleeve having a neodymium magnet at the distal end thereof is provided in the beater head. In an embodiment, a pull force of about one and one half pounds force may be provided, and in an embodiment, the pull force may be oriented along the longitudinal axis of the beater head. In various embodiments, the magnetic field provided by the magnet does not extend outward from the beater with sufficient field strength to attract a steel triangle. In an embodiment, this result may be achieved by using a steel or other ferromagnetic material for the inner sleeve into which a magnet is pressed, so that the inner sleeve modifies the available magnetic field. In various embodiments, the connector assembly and connector assembly receiver are separable by manually urging them apart and overcoming the magnetically attractive force therebetween, to thereby enable manual disengagement of the shaft and the beater head. In this manner, a selected beater head may be secured in place on the shaft after removal of the previously used beater head.

In an embodiment, a plurality of interchangeable beater heads may be provided in a kit. The kit may be provided with a container adapted for secure storage and transport of each one of the plurality of beater heads. Each of the interchangeable beater heads in the kit are configured with sufficient ferromagnetic materials therein for secure working engagement with the shaft of a triangle beater. In an embodiment, such ferromagnetic materials may include a steel sleeve in the beater head. In an embodiment, such ferromagnetic materials may include a magnet located at the distal end of the steel sleeve in the proximal end of the beater head.

More generally, the design concepts provided herein for interchangeable triangle beater heads provide for easy and quick change from a currently attached beater head to a different beater head, as may be desired for use as a musical performance proceeds.

BRIEF DESCRIPTION OF THE DRAWING

The present invention(s) are described herein by way of exemplary embodiments, using for illustration the accompanying drawing in which like reference numerals denote like elements in the various figures of the drawing, and in which.

Figure 1:
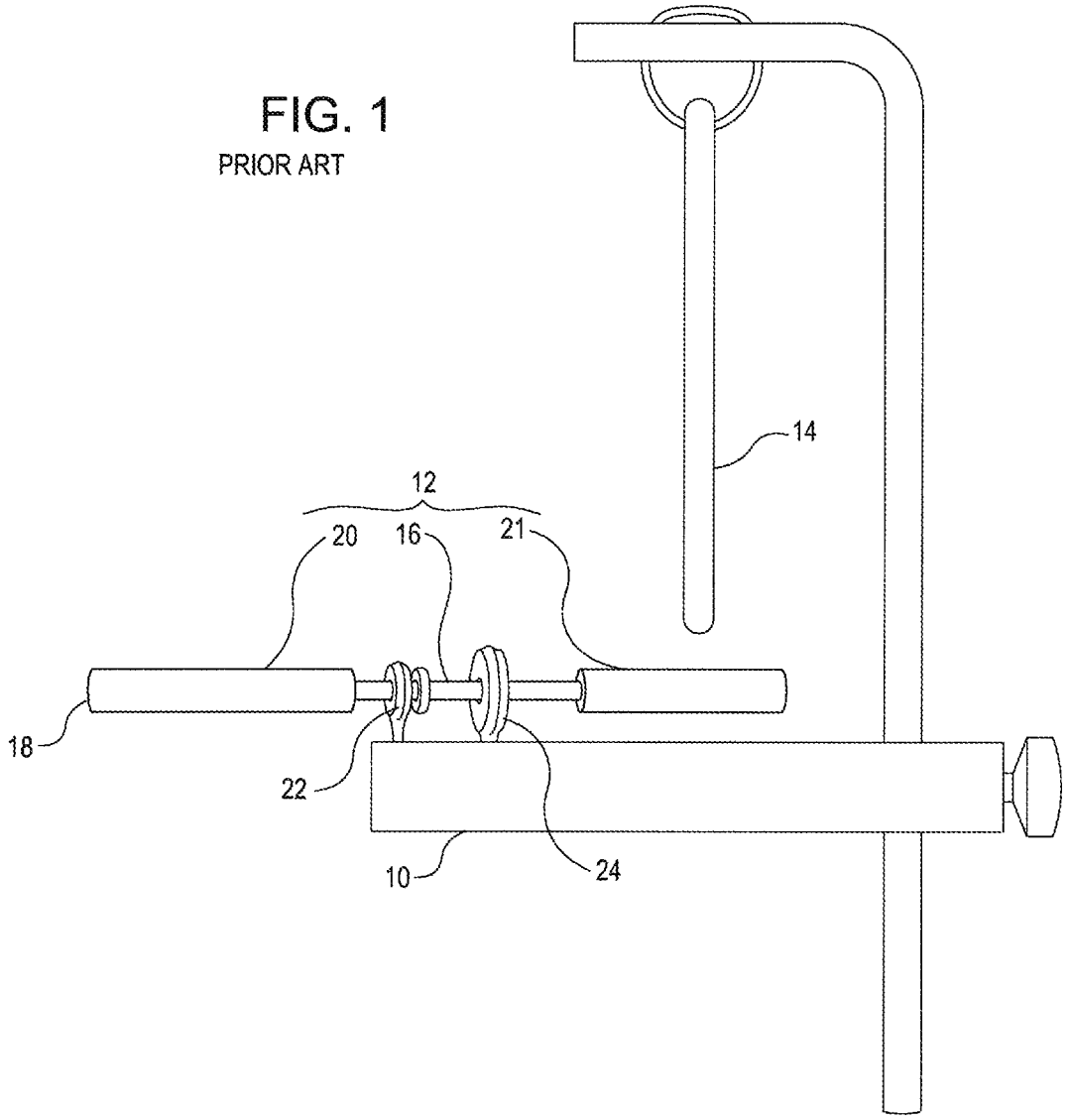
FIG. 1 PRIOR ART
FIG. 1 is an exemplary side elevation view of a prior art device for securing a triangle beater below a triangle, for operation by a percussionist during a musical performance, showing a prior art triangle beater in place, supported by a pair of grommets, and ready for operation.
Figure 2:
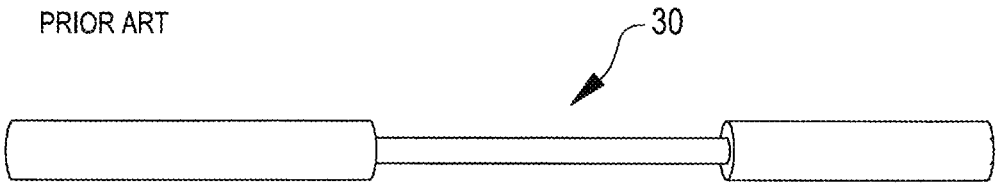
FIG. 2 PRIOR ART
FIG. 2 is an exemplary side elevation view of a prior art triangle beater, as may be used in a handheld fashion for use in a musical performance.

The foregoing figures, being merely exemplary, contain various elements that may be present or omitted from a particular final configuration for an embodiment of an interchangeable triangle beater head for use in a triangle beater. However, there is no intention to limit the claimed invention to any particular size or dimensional data, and any suggestion provided by any of the drawing figures of this specification are exemplary rather than mandatory. Thus, the interchangeable triangle beater head components used therein may be provided sized up or down from any dimensions depicted, without affecting the scope of the appended claims. An attempt has been made to draw the figures in a way that illustrates at least those elements that are significant for an understanding of exemplary interchangeable triangle beater heads for use with a triangle beater, and particulars may be varied for specific situations.

It should be understood that various features may be utilized in accord with the teachings hereof, as may be useful in different embodiments, depending upon the specific requirements such as spacing, magnetic strength, and materials, all within the scope and coverage of the teachings herein as defined by the claims. Further, like features in various embodiments for an interchangeable triangle beater head may be described using like reference numerals, or other like references, without further mention thereof.

DETAILED DESCRIPTION

Figure 3:
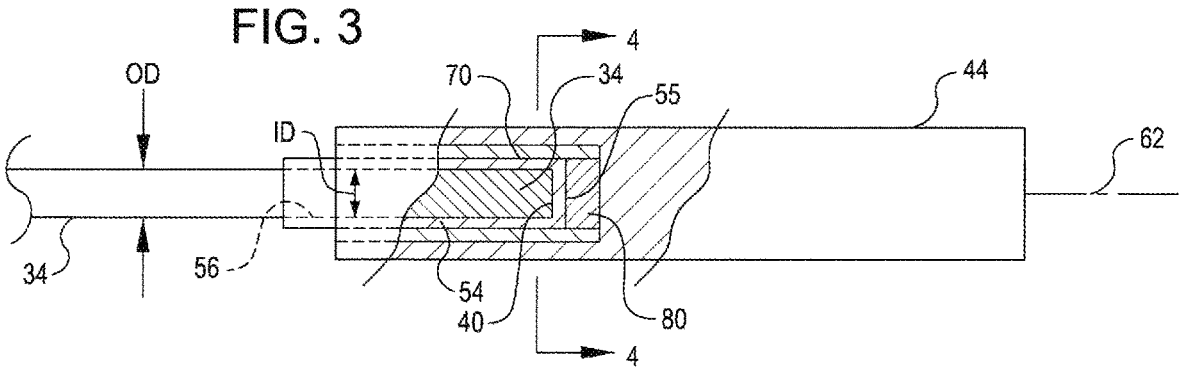
FIG. 3 is a partial side elevation view of a triangle beater shaft and attached beater head, and showing in partial cross section the interior structure for a connector assembly on the shaft and a connector receiving assembly within the proximal end of the beater head, showing the shaft, a cap on the shaft, and a tubular S cylindrical sleeve within the proximal end of the beater head, wherein the tubular cylindrical sleeve includes a small button type neodymium magnet press fit at the distal end thereof.
Figure 4:
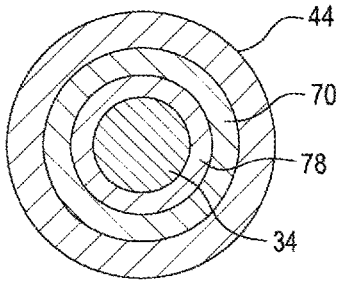
FIG. 4 is a vertical cross-sectional view, taken across line 4-4 of FIG. 3, showing the shaft, a cap on the shaft, and a tubular cylindrical sleeve in the proximal end of the beater head.
Figure 5:
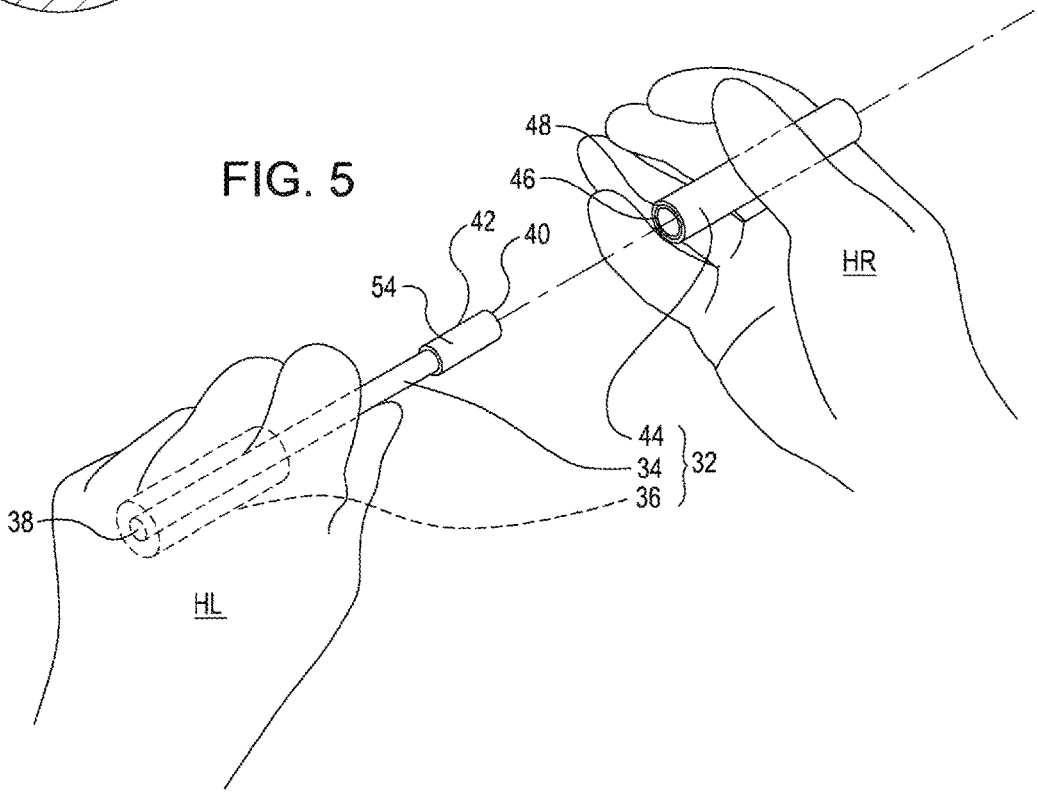
FIG. 5 is a perspective view showing manual detachment of an interchangeable beater head as described herein from a shaft, so that a different beater head may be installed on the shaft, showing in partial cross section the interior structure for a connector assembly on the shaft and a connector receiving assembly within the proximal end of the beater head, showing the shaft, a cap on the shaft, and a tubular cylindrical sleeve within the proximal end of the beater head, wherein the tubular cylindrical sleeve includes a small button type neodymium magnet press fit at the distal end thereof.

Attention is directed to FIGS. 3, 4, and 5, where exemplary design elements for a triangle beater with interchangeable beater heads is provided. As shown in FIG. 5, a triangle beater 32 may be provided for striking a triangle (e.g., see triangle 14 in FIG. 1). The triangle beater 32 may include a shaft 34 having a grip 36 (shown in hidden lines in FIG. 5) attached at a grip end 38, and a working end 40. In an embodiment, the working end 40 may further include a connector assembly 42. A beater head 44 is magnetically affixed to the connector assembly 42, at a connector assembly receiver 46 located at and extending axially inwardly from a proximal end 48 of the beater head 44. The connector assembly receiver 46 and the connector assembly 42 are configured with ferromagnetic components that when juxtaposed by bringing the connector assembly 42 and the connector assembly receiver 46 together into a working position (see FIG. 3), the connector assembly receiver 46 and the connector assembly 42 are magnetically secured together for striking a triangle (e.g. triangle 14). Further, as taught herein, the connector assembly 42 and connector assembly receiver 46 are separable by manually urging them apart (see FIG. 5, where a left hand HL and a right hand HR pull shaft 34 and connector assembly 42 away from beater head 44 and connector assembly receiver 46), and overcoming the magnetically attractive force therebetween. Yet, as further described herein below, in an embodiment, a magnet 80 may be provided in which the magnetic field does not extend outward with sufficient strength outward from the beater head 44 to magnetically attract a triangle (e.g., triangle 14) when the triangle is provided in a ferromagnetic materials such as steel. In an embodiment, this result may be achieved by using a steel or other ferromagnetic material for an inner sleeve 70 into which a magnet 80 is pressed, so that the inner sleeve 70 modifies the available magnetic field.

In an embodiment, a shaft 34 has a cap 54 affixed to the working end 40 of shaft 34 to form at least a portion of the connector assembly 42. In an embodiment, the cap 54 may be provided in a generally cup shaped structure for secure working engagement with the working end 40 of shaft 34. In an embodiment, the shaft 34 may be provided, at least in part, in the shape of a tubular cylinder element having an outer diameter OD, and a closed end 55. In such an embodiment, the cap 54 may include an axially extending interior hole defined by sidewalls 56 having an inner diameter ID. In such embodiments, the outer diameter OD and the inner diameter ID are each sized and shaped for secure interfitting engagement of the shaft 34 with the cap 54. In an embodiment, the cap 54 may be supplied using a ferromagnetic material. In an embodiment, the ferromagnetic material may be steel.

At the beater head 44, the connector assembly receiver 46 may be configured, at the proximal end 48 of the beater head 44, using an interior chamber 60 axially oriented and extending inwardly along the longitudinal axis 62 of beater head 44. This may be better seen in FIG. 6, the connector assembly receiver 46 is located at and extends axially inwardly from a proximal end 48 of the beater head 44. As also seen in FIG. 6, the interior chamber 60 may be defined by cylindrical interior chamber sidewalls 64 having an interior chamber diameter noted by reference character ICD.

In an embodiment, the beater head 44 may include a connector assembly receiver 46 that further includes an inner sleeve 70. The inner sleeve 70, when assembled, is located within the interior chamber 60, for secure interfitting engagement therewith. In an embodiment, the inner sleeve 70 may be configured as a cylindrical tube having a proximal end 72 and a distal end 74. The inner sleeve 70 has an inner sidewall 76. The inner sidewall 76 is size and shaped for interfitting mating engagement with the outer sidewall 78 of cap 54 of the connector assembly 42.

Figure 6:
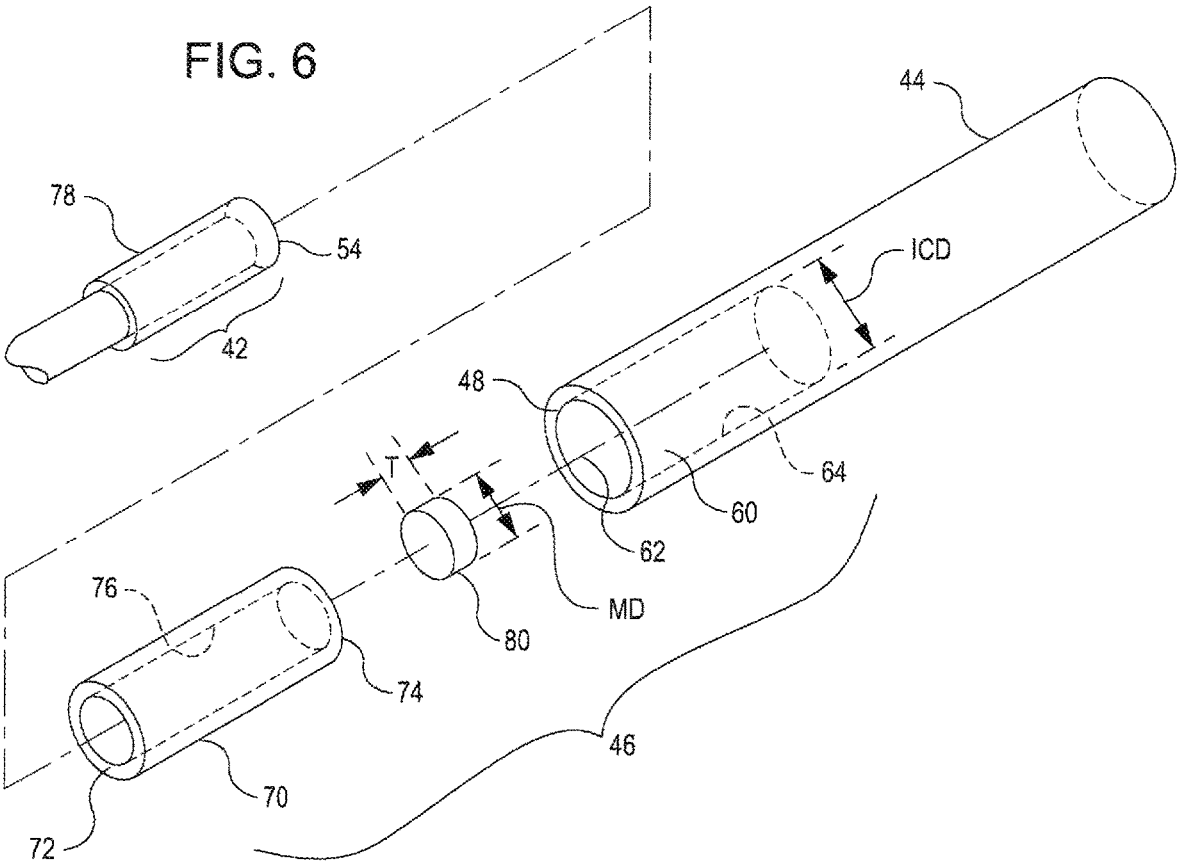
FIG. 6 is an exploded perspective view of a triangle beater with an interchangeable beater head as described herein, showing the various components which may be included in an embodiment, including a shaft having a ferromagnetic cap thereon, top form a connector assembly, and a connector receiving assembly within the proximal end of the beater head, showing a tubular cylindrical sleeve within the proximal end of the beater head, wherein the tubular cylindrical sleeve includes a small button type neodymium magnet press fit at the distal end thereof.

As seen in FIG. 6, a magnet 80 may be affixed at the distal end 74 of the inner sleeve 70. In an embodiment, magnet 80 may be provided in a cylindrical shape, and may be press fit into the distal end 74 of the inner sleeve 70. In an embodiment, the magnet 80 may be provided in the form of a neodymium magnet. I have found that, in an embodiment, it may be advantageous to use a model DH22 neodymium magnet from K&J Magnetics, Inc., with an address of 18 Appletree Ln., Pipersville, Pa. 18947, US, and having an internet store address at: https://www.kjmagnetics.com/. In an embodiment, the magnet 80 may be provided in a cylindrical shape, having thickness T about one eighth (⅛) of an inch, and a diameter MD of about two tenths (2/10) of an inch. In an embodiment, the magnetic field is located along an axis extending along the longitudinal axis 62 of the beater head 44. In an embodiment, the magnet 80 may be provided having a pull force of about 1.56 pounds force. As just noted above, in an embodiment, the pull force, i.e. the magnetic field, may be oriented along the longitudinal axis 62 of the beater head 44.

In an embodiment, when the magnet 80 is brought into proximity to the connector assembly 42, and more specifically cap 54, the connector assembly 42 and the connector receiver 46 are securely affixed each to the other. However, I have found it useful to provide a magnet sized, shaped, and with a magnetic force and field orientation so that the magnetic field does not extend outward with sufficient strength outward from the beater head 44 to magnetically attract a triangle 14, when the triangle 14 is provided in a ferromagnetic materials such as steel.

Figure 7:
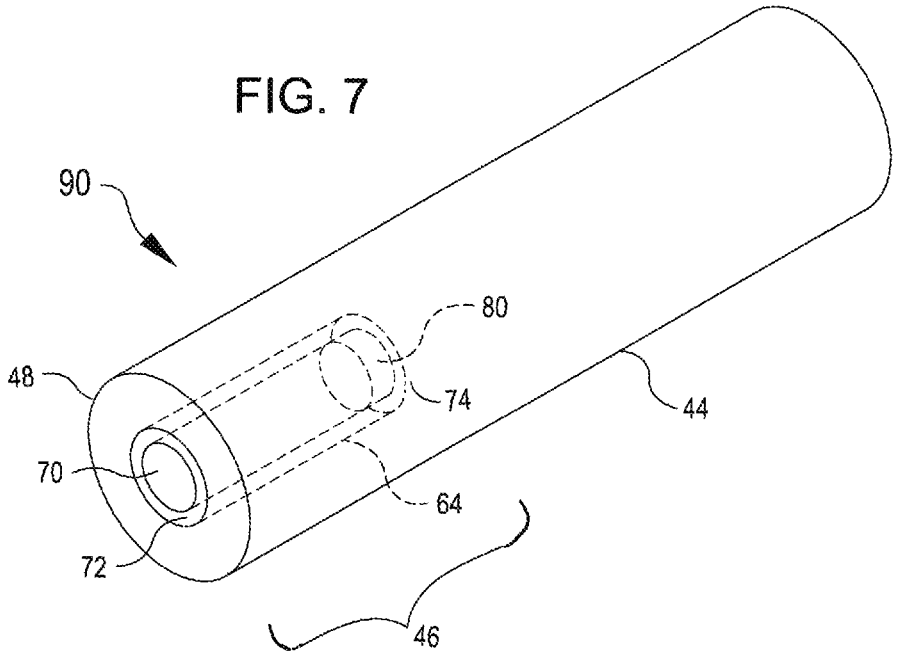
FIG. 7 is a perspective view of an embodiment for an interchangeable triangle beater, showing in hidden lines an embodiment for a connector assembly receiving structure at the proximal end of the beater head, showing a tubular cylindrical sleeve within the proximal end of the beater head, wherein the tubular cylindrical sleeve includes a small button type neodymium magnet press fit at the distal end thereof.

Attention is directed to FIG. 7, where a perspective view of an embodiment for an interchangeable triangle beater head 90 is provided. With details similar those shown in FIG. 6, the interchangeable triangle beater head 90 shown In FIG. 7 also utilizes a connector assembly receiver 46 and an inner sleeve 70 at and extending outward from the proximal end 48 of the beater head 44. In this embodiment, a tubular cylindrical inner sleeve 70 is used, which further includes a small button type neodymium magnet 80 which has been press fit at the distal end 74 thereof.

Figure 8:
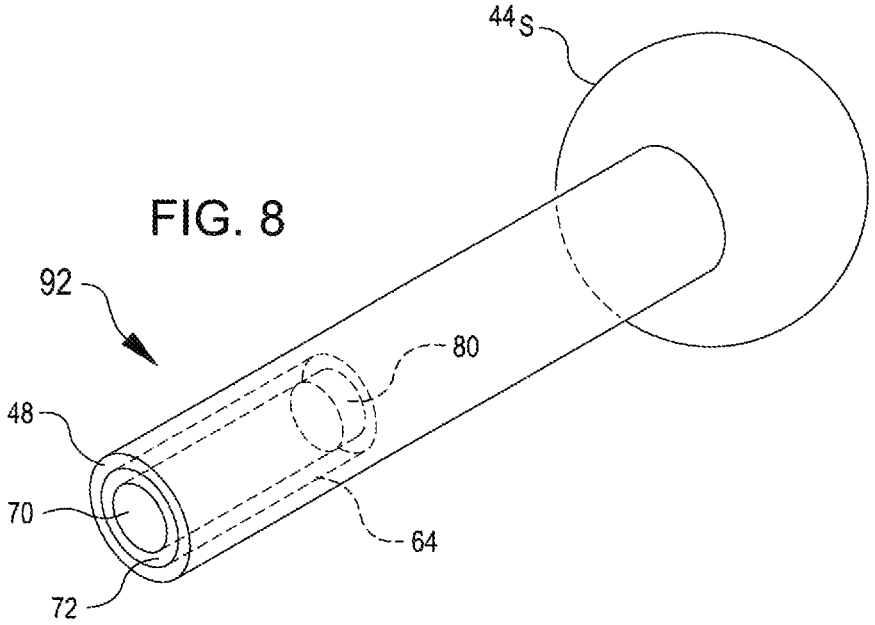
FIG. 8 is a perspective view of yet another embodiment for an interchangeable triangle beater, showing in hidden lines an embodiment for a connector assembly receiving structure at the proximal end of the beater head, showing a tubular cylindrical sleeve within the proximal end of the beater head, wherein the tubular cylindrical sleeve includes a small button type neodymium magnet press fit at the distal end thereof.

Similarly, FIG. 8 provides a perspective view of yet another embodiment for an interchangeable triangle beater head 92, showing in hidden lines an embodiment for a connector assembly receiver 46 at the proximal end 48 of the beater head 44. This view shows use, in hidden lines, of tubular cylindrical inner sleeve 70 at and extending outwardly from the proximal end 48 of the beater head 44. Also shown within the distal end of the tubular cylindrical inner sleeve 70 is a small button type neodymium magnet 80 press fit therein. Also in FIG. 8, a substantially spherical beater head $\mathbf{44}_S$ may be provided.

Figure 9:
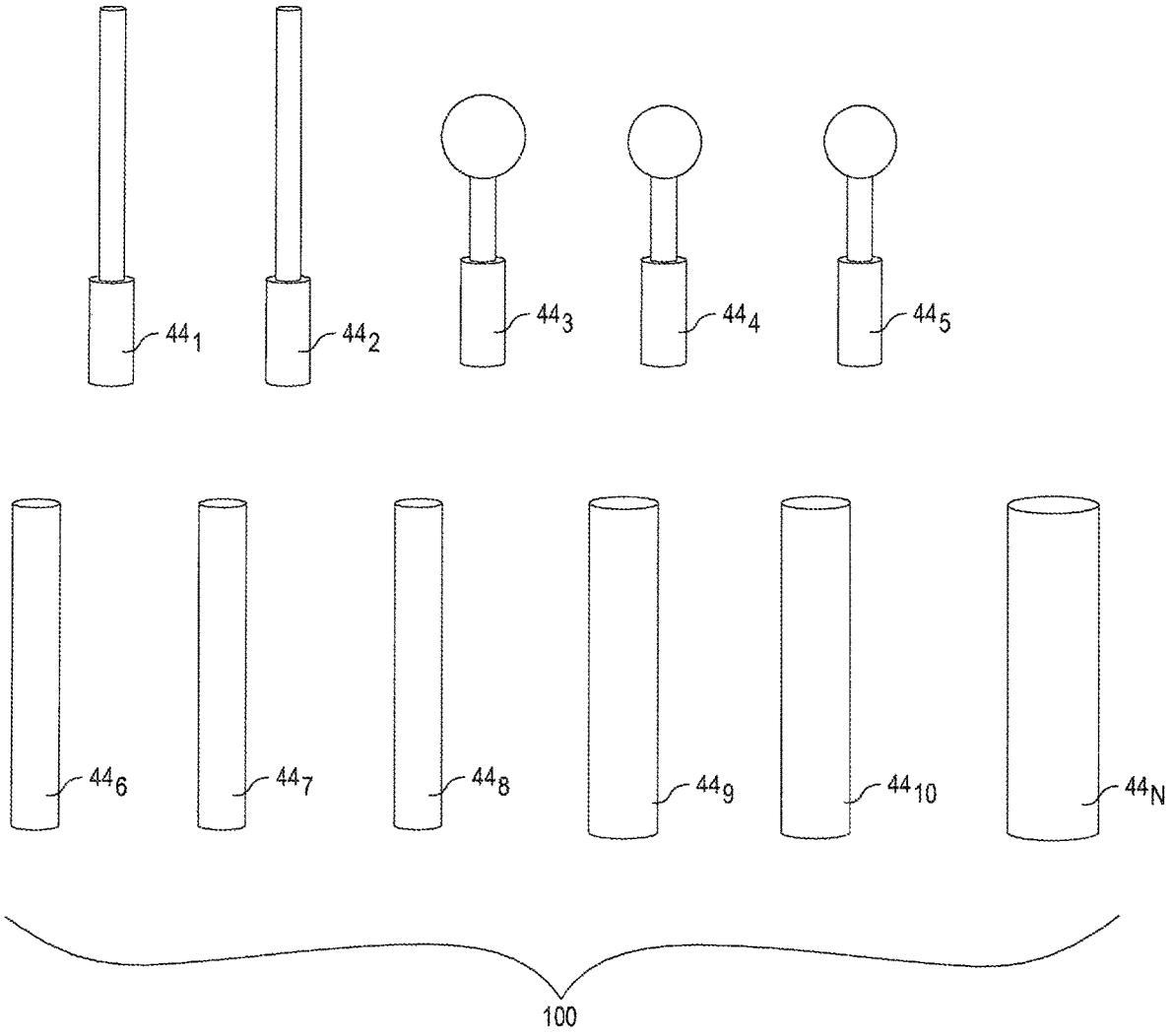
FIG. 9 shows a plurality of interchangeable triangle beater heads as described herein, as may be supplied in a kit.

FIG. 9 shows a plurality of interchangeable beater heads $\mathbf{44}_1$, $\mathbf{44}_2$, $\mathbf{44}_3$, to $\mathbf{44}_N$, etc. in a plurality of beater heads 44, where N is a positive integer, as may be provided in a kit 100 containing a plurality of interchangeable beater heads 44. The kit 100 may include a container for securely holding the plurality of interchangeable beater heads for storage and shipping. In various embodiments, a beater head may be provided in a selected material, such as aluminum, bronze, brass, steel, stainless steel, wood, or plastic.

The simple design as just described provides significant flexibility for a percussionist during a musical performance, since it provides for quick changes of beater heads for playing a triangle, and thus allows for various sounds to be produced as desired, without having to maintain a variety of triangle beaters, or setups for triangles and fixed triangle beaters. Accordingly, the designs provided afford a new setup for musicians, and is a significant advance in the art. Additionally, those of skill in the art may recognize that the instrument described herein as a triangle beater with interchangeable beater heads may also be used for playing other instruments, such as a cowbell or a wood block, and thus the apparatus as described herein may be used for such purposes, and the claims directed to triangle beater shall be equally applicable for coverage of cowbell beaters or wood block beaters, without the need for further mention thereof.

Although only a few exemplary embodiments have been described in detail, various details are sufficiently set forth in the drawings and in the specification provided herein to enable one of ordinary skill in the art to make and use the invention(s), which need not be further described by additional writing in this detailed description. It will be readily apparent to those skilled in the art of percussion instruments that the details as described herein may be useful in reducing overall costs for triangle beater collections, and as such may be modified from those embodiments provided herein, without materially departing from the novel teachings and advantages provided.

The aspects and embodiments described and claimed herein may be modified from those shown without materially departing from the novel teachings and advantages provided, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention(s) may be practiced otherwise than as specifically described herein. Thus, the scope of the invention(s), as set forth in the appended claims, and as indicated by the drawing and by the foregoing description, is intended to include variations from the embodiments provided which are nevertheless described by the broad interpretation and range properly afforded to the plain meaning of the claims set forth below.

The invention claimed is:

1. A triangle beater for striking a percussion instrument, comprising:

a grip;

a shaft, the shaft having a grip end and a working end, wherein the grip is attached to the grip end, and wherein the working end further comprises a connector assembly;

a beater head, the beater head extending along a longitudinal axis from a proximal end to a distal end, the beater head further comprising a connector assembly receiver;

wherein the connector assembly receiver and the connector assembly are configured with at least some components comprising ferromagnetic material that when juxtaposed by bringing the connector assembly and the connector assembly receiver together into a working position, the connector assembly receiver and the connector assembly are magnetically secured together for striking a triangle, and wherein the connector assembly and connector assembly receiver are separable by manually urging them apart and overcoming magnetically attractive force therebetween.

2. A triangle beater as set forth in claim 1, wherein the connector assembly comprises a cap, and wherein the cap is affixed to at least a portion of the working end of the shaft.

3. A triangle beater as set forth in claim 2, wherein the cap is provided in a cup shaped configuration, and wherein the cup is sized and shaped for secure interfitting engagement with the working end of the shaft.

4. A triangle beater as set forth in claim 3, wherein the working end of the shaft comprises a cylinder having an outer diameter OD, and wherein the cup comprises an interior hole having an inner diameter ID, and wherein the outer diameter OD and the inner diameter ID are each sized and shaped for secure interfitting engagement.

5. A triangle beater as set forth in claim 2, wherein the cap comprises a ferromagnetic material.

6. A triangle beater as set forth in claim 2, wherein the ferromagnetic material comprises steel.

7. A triangle beater as set forth in claim 1, wherein the connector assembly receiver comprises, at the proximal end of the beater head, an interior chamber axially oriented and extending inwardly along the longitudinal axis.

8. A triangle beater as set forth in claim 7, wherein the interior chamber is defined by cylindrical interior chamber sidewalls having a diameter ICD.

9. A triangle beater as set forth in claim 8, wherein the connector assembly receiver further comprises an inner sleeve, and wherein the inner sleeve is located within the interior chamber, for secure interfitting engagement therewith.

10. A triangle beater as set forth in claim 9, wherein the inner sleeve comprises a cylindrical tube having a proximal end and a distal end.

11. A triangle beater as set forth in claim 10, further comprising a magnet, the magnet affixed at the distal end of the inner sleeve, and wherein when the magnet is brought into proximity to the cap, the connector assembly and the connector assembly receiver are securely affixed one to the other.

12. A triangle beater as set forth in claim 11, wherein the magnet comprises a neodymium magnet.

13. A triangle beater as set forth in claim 12, wherein the magnet has a pull force of about 1.56 pounds force, and wherein the pull force is oriented along the longitudinal axis of the beater head.

14. A triangle beater as set forth in claim 12, wherein the magnet is cylindrical in shape.

15. A triangle beater as set forth in claim 14, wherein the magnet has a diameter MD of about two tenths (2/10) of an inch.

16. A triangle beater as set forth in claim 15, wherein the magnet has a thickness T of about one eighth (1/8) of an inch.

17. A triangle beater as set forth in claim 11, wherein the inner sleeve comprises a ferromagnetic material, and wherein the magnet has a magnetic field which, when located in the inner sleeve, does not extend outward from the beater head with sufficient strength to magnetically attract a triangle, when the triangle comprises steel.

18. A triangle beater as set forth in claim 1, wherein the beater head comprises a material selected from the group consisting of aluminum, bronze, brass, steel, stainless steel, wood, and plastic.

19. A kit of a plurality of beater heads for a striking a percussion instrument, the kit comprising:

a plurality of detachable beater heads, each of the detachable beater heads adapted for interchangeable use on the triangle beater of claim 1.

20. A kit as set forth in claim 19, further comprising a container, the container adapted for secure storage of a plurality of interchangeable beater heads.

* * * * *